US007730835B2

(12) United States Patent
Iwamoto

(10) Patent No.: US 7,730,835 B2
(45) Date of Patent: Jun. 8, 2010

(54) HOLDING APPARATUS FOR HOLDING A FLEXIBLE PLATE ON A CIRCUMFERENTIAL SURFACE OF A HOLDER OF A PRINTING MACHINE

(75) Inventor: Torao Iwamoto, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 218 days.

(21) Appl. No.: 11/920,147

(22) PCT Filed: Jun. 15, 2006

(86) PCT No.: PCT/JP2006/311982

§ 371 (c)(1),
(2), (4) Date: Dec. 13, 2007

(87) PCT Pub. No.: WO2006/137313

PCT Pub. Date: Dec. 28, 2006

(65) Prior Publication Data

US 2009/0120314 A1 May 14, 2009

(30) Foreign Application Priority Data

Jun. 24, 2005 (JP) ..... 2005-185605

(51) Int. Cl.
*B41F 27/12* (2006.01)

(52) U.S. Cl. ..... 101/415.1; 101/378

(58) Field of Classification Search ..... 101/415.1, 101/378, 382.1
See application file for complete search history.

(56) References Cited

U.S. PATENT DOCUMENTS

| | | | | |
|---|---|---|---|---|
| 3,382,799 | A * | 5/1968 | Luehrs | 101/415.1 |
| 5,454,316 | A * | 10/1995 | Ohta et al. | 101/415.1 |
| 6,457,411 | B2 | 10/2002 | Yoshizawa et al. | |
| 6,601,508 | B1 | 8/2003 | Chagnon | |
| 6,796,233 | B2 * | 9/2004 | Brown et al. | 101/382.1 |
| 2002/0005131 | A1 * | 1/2002 | Yoshizawa et al. | 101/415.1 |
| 2002/0005132 | A1 * | 1/2002 | Yoshizawa et al. | 101/415.1 |

FOREIGN PATENT DOCUMENTS

| | | |
|---|---|---|
| JP | U H04-7133 | 1/1992 |
| JP | U H05-26373 | 4/1993 |
| JP | H07-68737 | 3/1995 |
| JP | 2004-74526 | 3/2004 |

* cited by examiner

*Primary Examiner*—Leslie J Evanisko
(74) *Attorney, Agent, or Firm*—Manabu Kanesaka; Benjamin Hauptman; Kenneth Berner

(57) ABSTRACT

A holding apparatus holds a flexible plate wound on a circumferential surface of a holder of a printing machine. A holding apparatus includes a hole section made in the holder along an axial direction of the holder, a groove section made by notching the circumferential surface of the holder along the axial direction to establish a connection with the hole section and accept insertion of a leading edge end portion and trailing edge end portion of the plate, a tension bar inserted and fitted into the hole section for engaging the trailing edge end portion of the plate, and a rotating mechanism provided in the hole section for rotating the tension bar.

7 Claims, 12 Drawing Sheets

Z–Z

S-S (MOUNTING POSITION)

DETAILS OF SECTION M

P-P
(WITHDRAWING POSITION)

P-P
(MOUNTING POSITION)
(AT INSERTION)

P-P
(MOUNTING POSITION)
(COMPLETION OF INSERTION)

P-P
(FASTENING POSITION)

HOLDING APPARATUS FOR HOLDING A FLEXIBLE PLATE ON A CIRCUMFERENTIAL SURFACE OF A HOLDER OF A PRINTING MACHINE

TECHNICAL FIELD

The present invention relates to a holding apparatus for holding a plate on a circumferential surface of a holder, and more particularly to a holding apparatus suitable for use in the retention of a plate on a circumferential surface of a sleeve of a plate cylinder of a printing machine.

BACKGROUND ART

So far, there have been developed various types of plate holding apparatuses which are for holding a plate on a plate cylinder of a printing machine. For example, the Patent Document 1 discloses a plate holding apparatus designed such that a leaf spring for engaging a trailing edge end portion of a plate is provided along an axial direction of a tension bar and a lever fixedly secured onto an axial end portion of the tension bar is moved by a spring so as to rotate the tension bar so that the trailing edge end portion of the plate is drawn into a slit of a plate cylinder by the leaf spring to hold the plate on a circumferential surface of the plate cylinder.

In addition, the Patent Document 2 discloses a plate holding apparatus designed such that a leaf spring for engaging a trailing edge end portion of a plate is provided along an axial direction of a tension bar as well as the Patent Document 1 and a lever fixedly secured onto an axial end portion of the tension bar is moved by use of a working cylinder instead of a spring so as to rotate the tension bar so that the trailing edge end portion of the plate is drawn into a slit of a plate cylinder by the leaf spring to hold the plate on a circumferential surface of the plate cylinder.

Patent Document 1: Japanese Utility Model Laid-Open No. HEI 4-7133

Patent Document 2: Japanese Patent Laid-Open No. 2000-301694

DISCLOSURE OF THE INVENTION

Problems to be Solved by the Invention

However, in the case of the above-mentioned Patent Documents 1 and 2, a rotating mechanism such as a lever, a spring or a working cylinder for rotating a tension bar is located at an end portion of a plate cylinder, which increases the size of the apparatus. In particular, in the recent years, there has been developed a technique in which a cylindrical sleeve is mounted in a support so as to freely change the diameter of a plate cylinder and, in this case, although there is a need to hold a plate on a circumferential surface of the sleeve, since such a sleeve has an extremely thin thickness such as approximately 20 mm, difficulty is encountered in employing plate holding apparatus disclosed in the Patent Documents 1 and 2.

The present invention has been developed in consideration of such problems, and it is an object of the invention to provide a holding apparatus suitable particularly for a plate cylinder sleeve having a small thickness and capable of decreasing the size of the apparatus.

Means for Solving the Problems

For solving the above-mentioned problems, a holding apparatus according to the present invention, which is made to hold a flexible plate wound on a circumferential surface of a holder comprises a hole section formed in the holder along an axial direction of the holder, a groove section formed on the circumferential surface of the holder along the axial direction to connect with the hole section for accepting insertion of one edge as a leading edge end portion and another edge as a trailing edge end portion of the plate, a tension bar inserted and fitted into the hole section for engaging the trailing edge end portion of the plate, and a rotating mechanism provided in the hole section for rotating the tension bar.

In addition, preferably, the rotating mechanism is capable of selecting a rotational phase position of the tension bar from any one of positions which are a mounting position at which the trailing edge end portion is set in the groove section, a fastening position at which the trailing edge end portion is drawn into the groove section and the plate is fastened onto the circumferential surface of the holder, and a withdrawing position at which the trailing edge end portion is released from the interior of the groove section.

This enables the rotational phase position of the tension bar to be selected to one of the mounting position, the fastening position and the withdrawing position, which allows easy attachment/detachment of the plate. Thus, one person can easily carry out the operation for the attachment and detachment of the plate.

Still additionally, the tension bar preferably has a hook for engaging the trailing edge end portion of the plate.

This enables the trailing edge end portion of the plate to be fixedly hooked by the hook of the tension bar, which prevents the trailing edge end portion from getting out of place during the mounting operation for the plate, thereby facilitating the plate mounting operation.

Yet additionally, preferably, the rotating mechanism has a torsion spring biasing the tension bar in a direction of drawing the trailing edge end portion of the plate into the groove section and, at the fastening position, the tension bar is further rotatable by a predetermined quantity in a direction of drawing the plate thereinto.

Thus, even if the plate lengthens and the trailing edge end portion of the plate shifts, the tension bar is rotated according to this shifting, so the trailing edge end portion of the plate can always be drawn into the groove section, which can prevent the plate from becoming loose, thereby reliably fixedly securing the plate onto the circumferential surface of the holder.

Moreover, preferably, the torsion spring is mounted on each of both end portions of the tension bar.

Thus, the rotating force is applied to both the end portions of the tension bar, which can reduce the torsion of the tension bar.

Still moreover, preferably, the holder is composed of a cylindrical sleeve.

This allows the installation on the cylindrical sleeve and, hence, the attachment/detachment of the plate can be made in a state where the cylindrical sleeve is detached from the holder, which improves the working efficiency.

Advantages of the Invention

With the holding apparatus according to the present invention, the hole section into which the tension bar is inserted and fitted can be equipped with the rotating mechanism, which can achieve the size reduction of the apparatus and which can hold the plate (for example, printing plate, metal blanket) reliably.

DESCRIPTION OF REFERENCE NUMERALS

Figure 1:
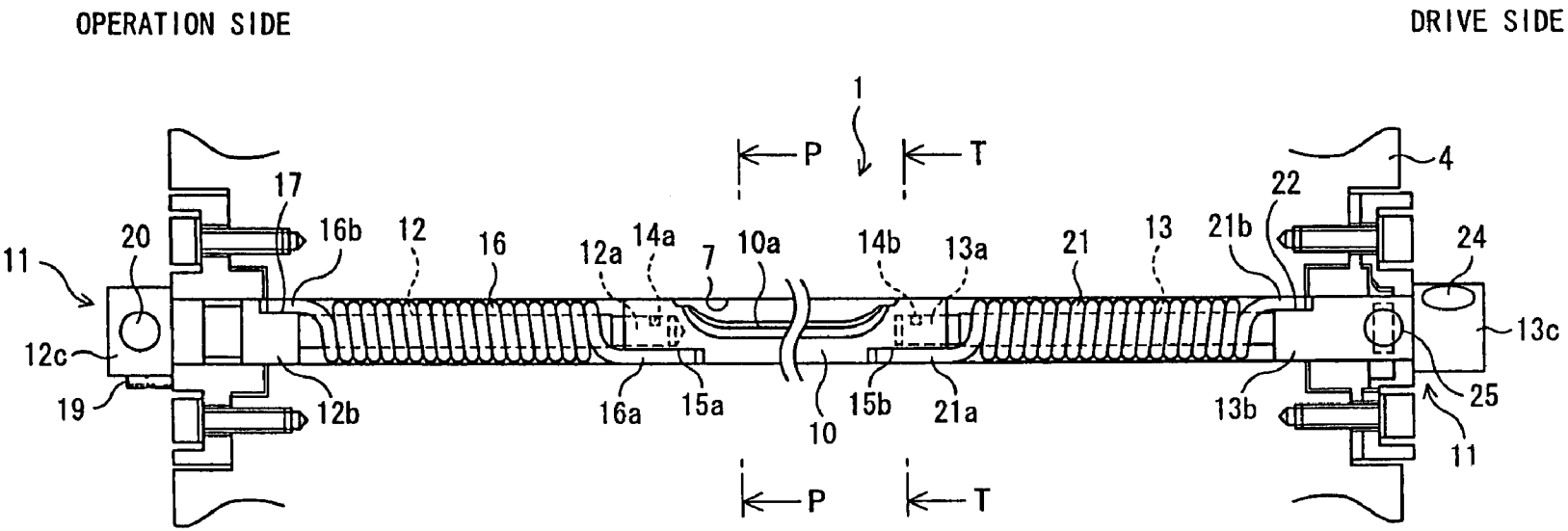
[FIG. 1] a structural view showing an essential part of a holding apparatus according to an embodiment of the present invention.

1 holding apparatus
2 plate cylinder
3 support
4 sleeve (holder)
5 plate (flexible plate)
7 hole section
8 groove section (slit)
10 tension bar
10*a* hook
11 rotating mechanism
12 first supporting shaft
12*a* drive side end portion of first supporting shaft
12*b* operation side end portion of first supporting shaft
12*c* first handle
12*d* cavity portion
13 second supporting shaft
13*a* operation side end portion of second supporting shaft
13*b* drive side end portion of second supporting shaft
13*c* second handle
14*a* engaging hole made in an operation side end portion of tension bar
14*b* spring engaging hole made in an operation side end portion of tension bar
14*b* engaging hole made in a drive side end portion of tension bar
15*b* spring engaging hole made in a drive side end portion of tension bar
16 torsion spring
16*a* drive side end portion of torsion spring
16*b* operation side end portion of torsion spring
17 spring engaging hole made in an operation side end portion of first supporting shaft
19 stopper
20 wrench mounting hole
21 torsion spring
21*a* operation side end portion of torsion spring
21*b* drive side end portion of torsion spring
22 spring engaging hole made in a drive side end portion of second supporting shaft
24 wrench mounting hole
25 stopper
25*a*, 25*b*, 25*c* cavity portion
26, 27 plunger pin
26*a*, 27*a* belleville spring
28, 29 restriction wall

BEST MODE FOR CARRYING OUT THE INVENTION

Referring to the drawings, a description will be given hereinbelow of an embodiment of the present invention.

Figure 4:
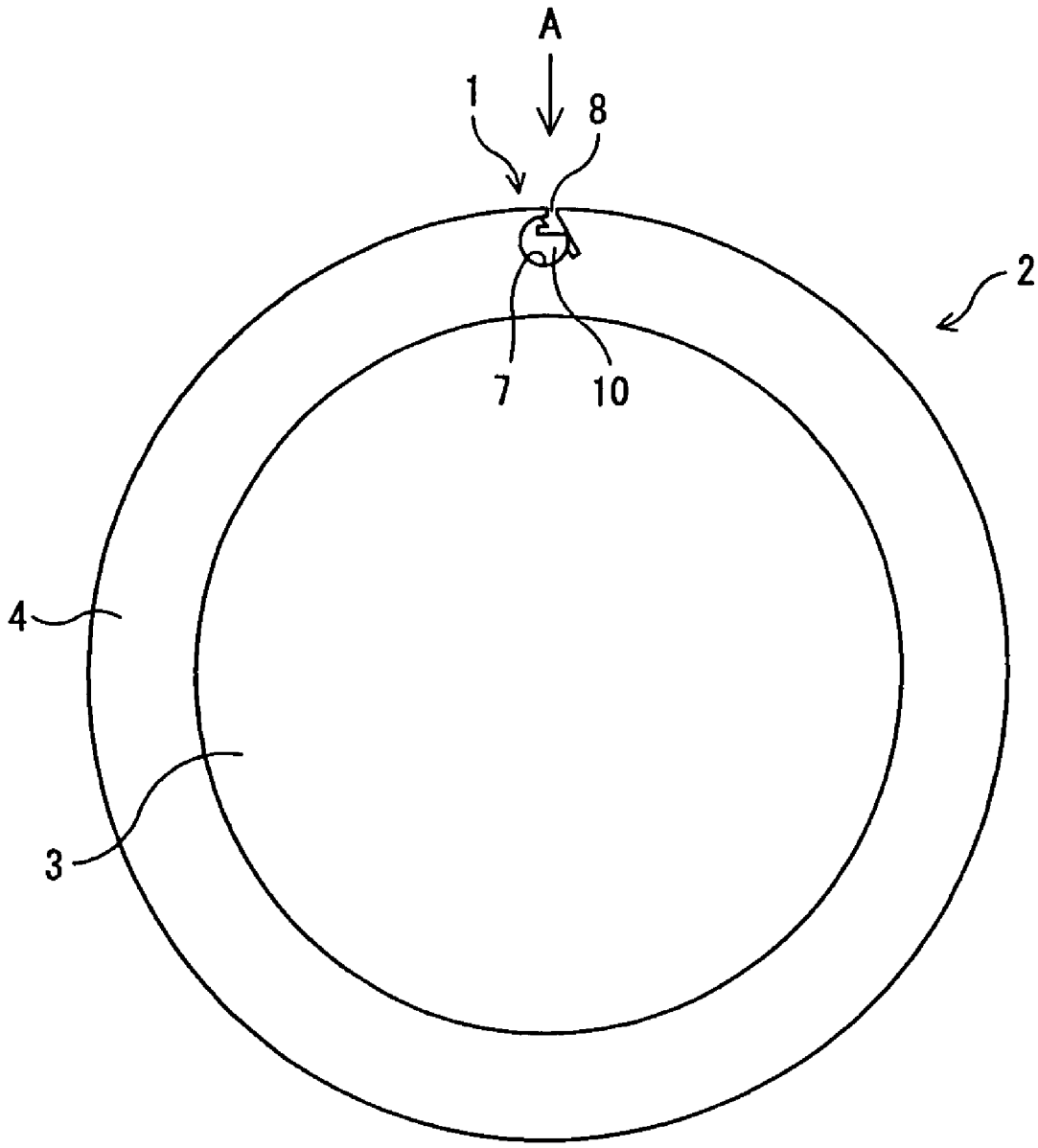
[FIG. 4] a cross-sectional view taken along Z-Z of FIG. 3.
Figure 5:
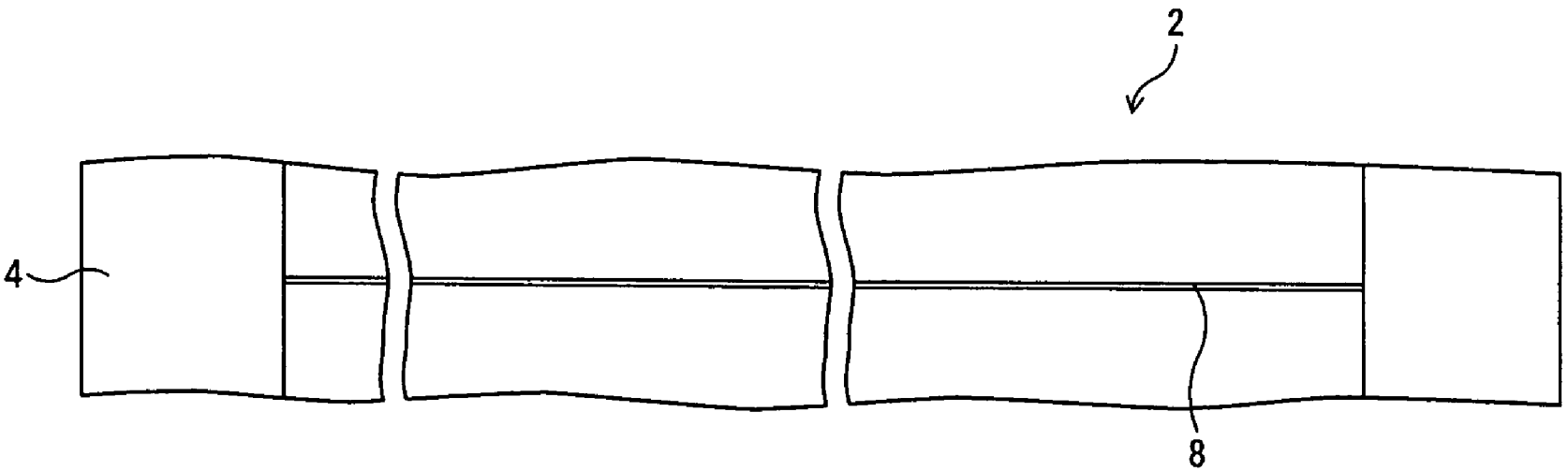
[FIG. 5] an illustration viewed from a direction A of an arrow in FIG. 4.
Figure 6:
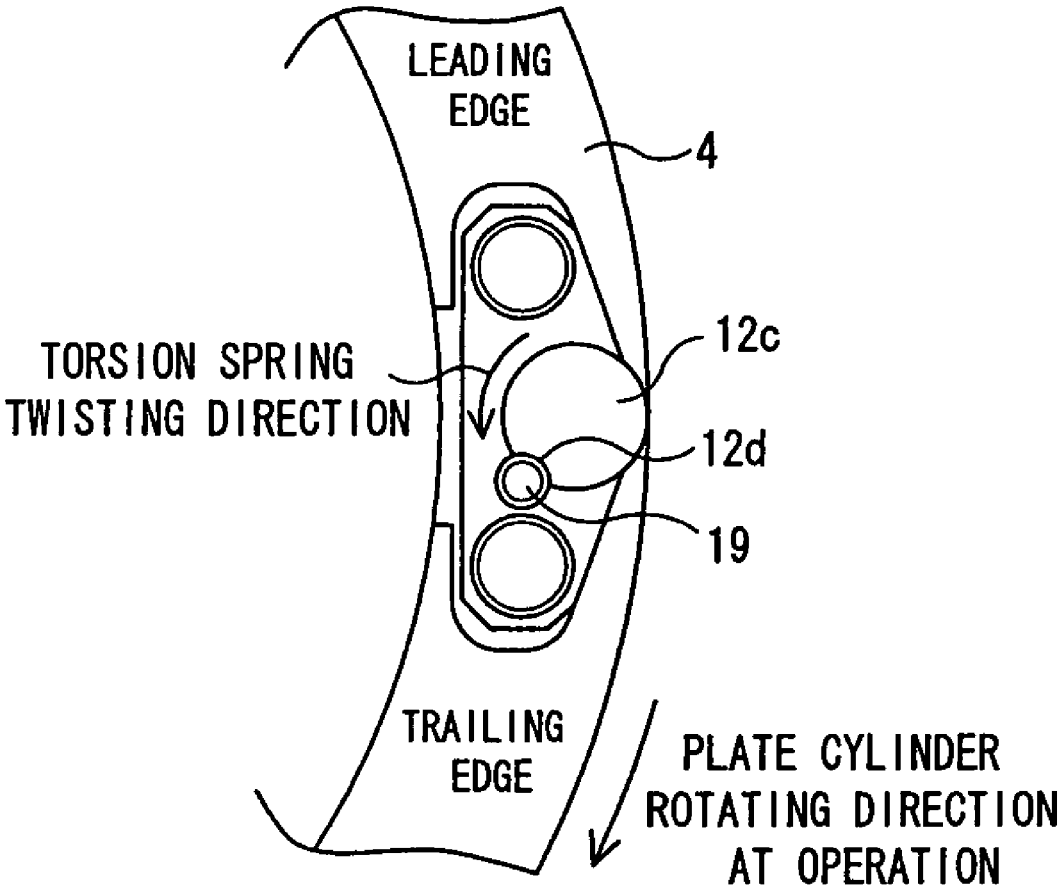
[FIG. 6] a side-elevational illustration of an essential part of a holding apparatus according to an embodiment of the present invention viewed from an operation side.
Figure 7:
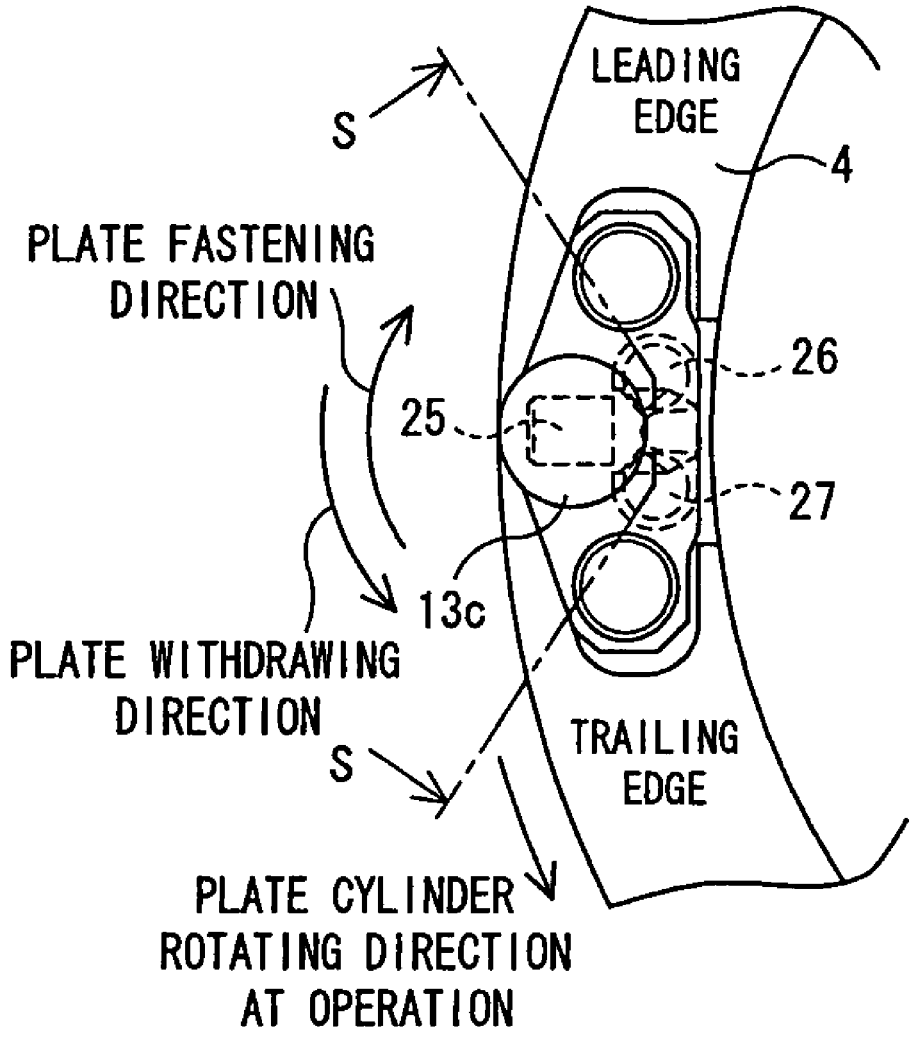
[FIG. 7] a side-elevational illustration of an essential part of a holding apparatus according to an embodiment of the present invention viewed from a drive side.
Figure 8:
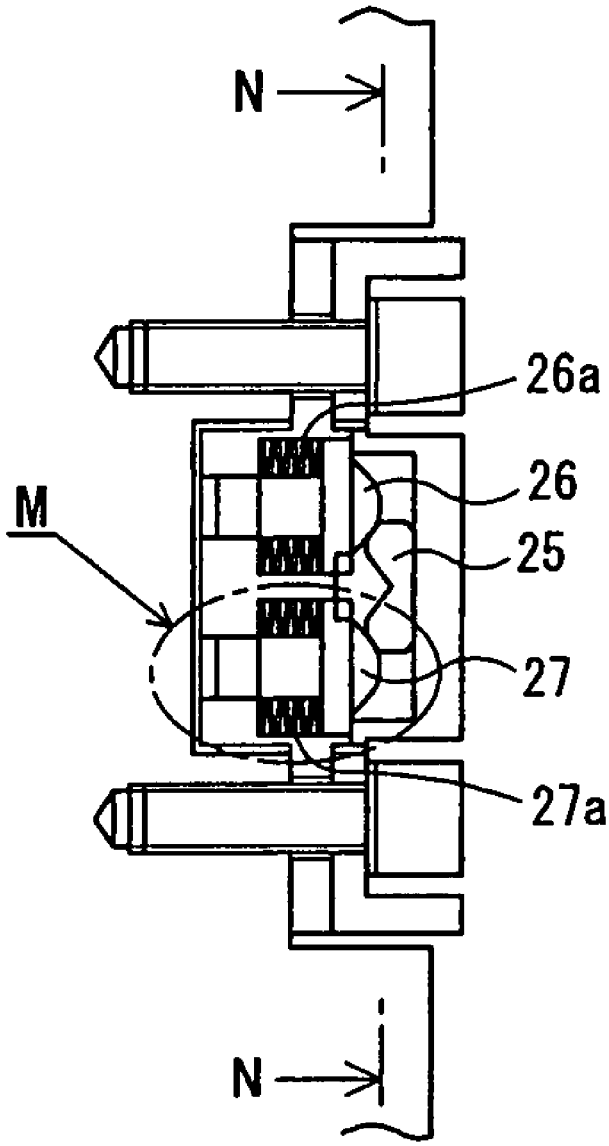
[FIG. 8] a cross-sectional view taken along S-S of FIG. 7.
Figure 9:
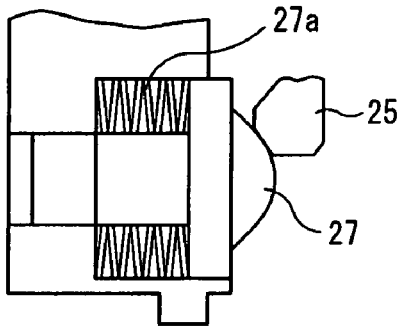
[FIG. 9] a detailed illustration of a section M of FIG. 8.
Figure 13:
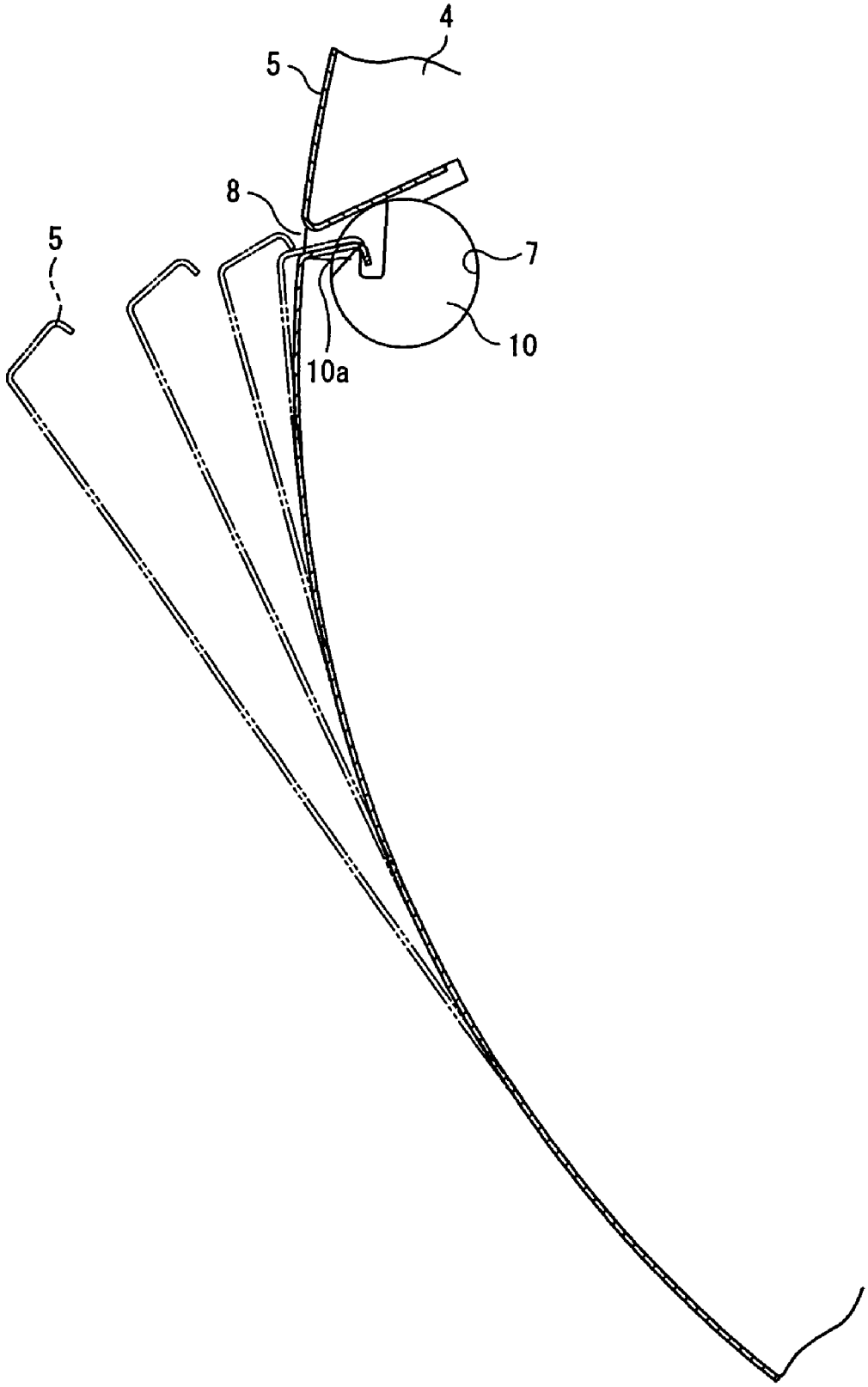
[FIG. 13] an illustration for explaining an operation of a plate at the attachment/detachment of the plate.

FIGS. 1 to 13 are illustrations for explaining a holding apparatus according to an embodiment of the present invention. FIG. 1 is a structural view showing an essential part thereof, FIG. 2 is a perspective view showing a plate cylinder, FIG. 3 is a cross-sectional view showing a plate cylinder taken along an axial direction of the plate cylinder, FIG. 4 is a cross-sectional view taken along Z-Z of FIG. 3, FIG. 5 is an illustration viewed from a direction A of an arrow in FIG. 4, FIG. 6 is a side-elevational illustration of an essential part viewed from an operation side, FIG. 7 is a side-elevational illustration of an essential part viewed from a drive side, FIG. 8 is a cross-sectional view taken along S-S of FIG. 7, FIG. 9 is a detailed illustration of a section M of FIG. 8, FIGS. 10(*a*) to 10(*c*) are illustrations for explaining operations of a rotating mechanism, FIGS. 11(*a*) to 11(*d*) are cross-sectional views taken along T-T of FIG. 1, FIGS. 12(*a*) to 12(*d*) are cross-sectional views taken along P-P of FIG. 1, and FIG. 13 is an illustration for explaining an operation of a plate at the attachment of the plate.

Figure 2:
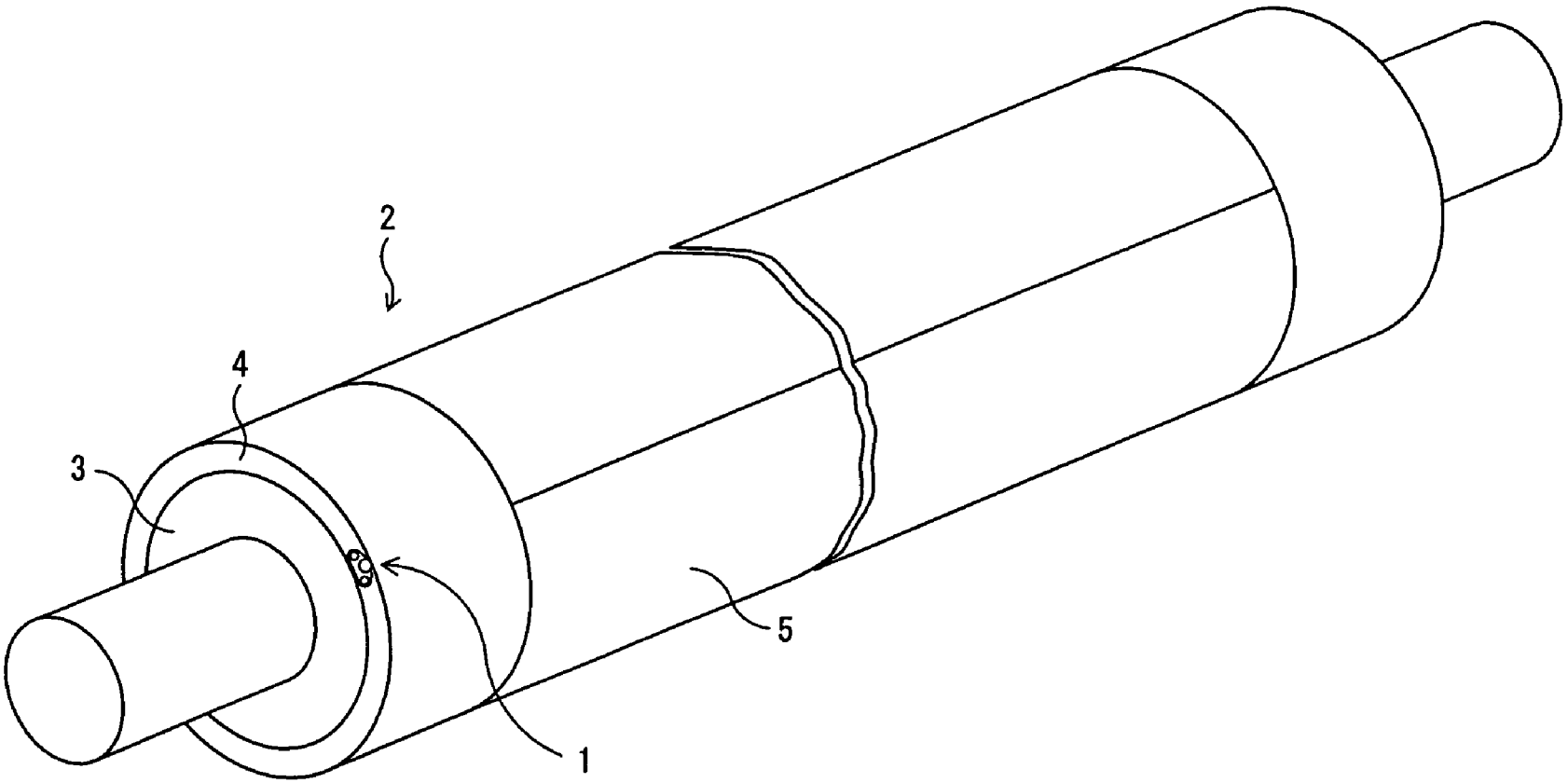
[FIG. 2] a perspective view showing a plate cylinder according to an embodiment of the present invention.
Figure 3:
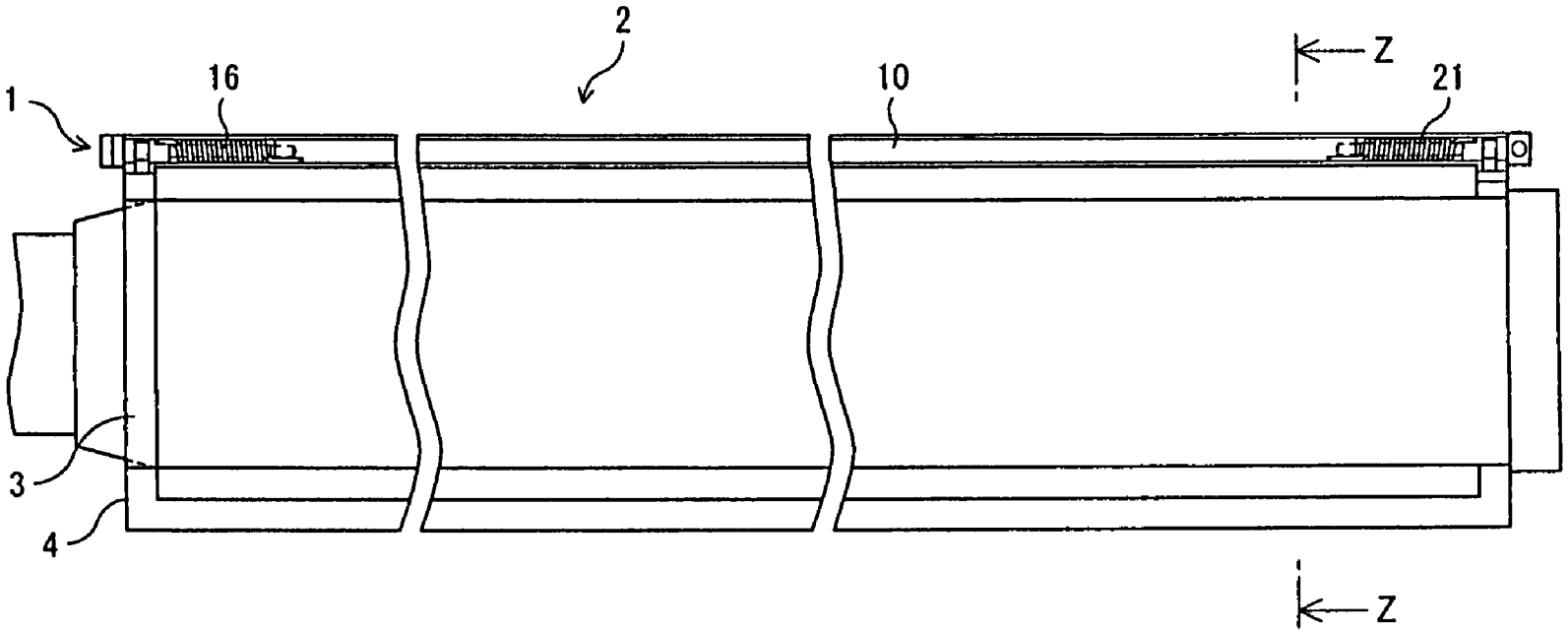
[FIG. 3] a cross-sectional view showing a plate cylinder taken along an axial direction of the plate cylinder according to an embodiment of the present invention.

As shown in FIGS. 2 and 3, a holding apparatus 1 according to this embodiment is provided on a printing cylinder (although a printing machine has a plate cylinder and a blanket cylinder, the following description will be given as an example about a plate cylinder) 2. In this case, the plate cylinder 2 is composed of a support 3 and a cylindrical plate cylinder sleeve (holder; which will hereinafter be referred to simply as sleeve) 4 mounted on a circumferential surface of the support 3, and the sleeve 4 having a different thickness is mounted on the support 3, which enables a free change of the diameter of the plate cylinder 2. Although the thickness of the sleeve 4 is, for example, as very thin as approximately 20 mm, since this holding apparatus 1 is designed to be considerably more compact in comparison with a conventional holding apparatus as mentioned later, this holding apparatus 1 can easily be placed on such a small-thickness sleeve 4. Moreover, as shown in FIG. 2, the plate (flexible plate; in the case of a blanket cylinder, a blanket sheet such as a metal blanket) 5 is mounted on a circumferential surface of the sleeve 4 in a state wound thereon through the use of this holding apparatus 1. Although the following description will be given with respect to an example in which this holding apparatus 1 is provided on the sleeve 4, it is also possible that this holding apparatus 1 is directly placed on a plate cylinder which does not employ the sleeve 4 (that is, plate itself which is of a type having no sleeve). Still moreover, the sleeve 4 is, on an inner circumferential surface thereof, equipped with an elastic body (not shown) having a diameter slightly smaller than an outer diameter of the support 3. At the attachment of the sleeve, the elastic body is expanded by applying high-pressure air from an outer circumferential surface of the support 3 toward the diameter outside and the sleeve 4 is inserted in an axial direction of the support 3. After the insertion of the sleeve 4, the supply of the high-pressure air is stopped to reduce the diameter of the elastic body so that the sleeve 4 is fixedly secured onto the outer circumferential surface of the support 3.

As shown in FIG, 1, this holding apparatus 1 has a hole section 7 made along an axial direction of the interior of the sleeve 4, a tension bar 10 inserted and fitted into the hole section 7 and a rotating mechanism 11 located in the hole section 7 for rotating the tension bar 10. Moreover, as shown in FIGS. 4 and 5, this holding apparatus 1 has a groove section 8 formed by making a notch in the circumferential surface of the sleeve 4 along an axial direction and connected to the hole section 7, with a leading edge end portion (one edge) and trailing edge end portion (another edge) (see FIG. 12) of the plate 5 being inserted into this groove section 8.

As shown in FIG, 1, the tension bar 10 is located at a generally central portion of the hole section 7 in the axial direction, and the tension bar 10 is equipped with an hook 10*a* [for example, see FIG. 12(*a*)] for engaging the trailing edge end portion of the plate 5. Moreover, the rotating mechanism 11 is designed to select a rotational phase position of the tension bar 10 from any one of mounting positions at which the trailing edge end portion of the plate 5 is mounted in the groove section 8, a fastening position at which the trailing edge end portion of the plate 5 is drawn into the groove section 8 and the plate 5 is fastened onto the circumferential surface of the sleeve 4 and a withdrawing position at which the trailing edge end portion is released from the interior of the groove section 8.

With reference to FIG. 1, a concrete description will be given of the rotating mechanism 11. A first supporting shaft 12 is located at an operation side (one end portion) of the tension bar 10. A drive side end portion 12*a* of the first supporting shaft 12 is inserted and fitted into an engaging hole 14*a* made in an operation side end portion of the tension bar 10 to be rotatable and slidable. Moreover, a torsion spring (first torsion spring) 16 is provided to be wound around an outer circumference of the first supporting shaft 12. Still moreover, a drive side end portion 16*a* of the torsion spring 16 is inserted and fitted into a spring engaging hole 15*a*, made in the operation side end portion of the tension bar 10, to be stopped in a state engaged therewith, while an operation side end portion 16*b* of the torsion spring 16 is inserted and fitted into a spring engaging hole 17, made in an operation side end portion 12*b* of the first supporting shaft 12, to be stopped in a state engaged therewith.

In addition, a first handle (first operating portion) 12*c* is made on the operation side end portion 12*b* of the first supporting shaft 12. The first handle 12*c* protrudes from the hole section 7 of the sleeve 4 toward the operation side exterior, and when the first handle 12*c* is rotated in a direction (plate fastening direction) that the trailing edge end portion of the plate 5 is drawn into the groove section 8 by means of the tension bar 10, the torsion spring 16 can be twisted so as to bias the tension bar 10 in the aforesaid plate drawing direction.

That is, since the first supporting shaft 12 and the tension bar 10 are no restraint upon each other in the shaft rotating direction, at the assembling, difficulty is encountered in previously applying torsion to the torsion spring 16 between the first supporting shaft 12 and the tension bar 10. Accordingly, after the assembling of the tension bar 10, the torsion spring 16 and the first supporting shaft 12, the first handle 12*c* is rotated to apply a biasing force so that the torsion spring 16 is biased in the plate drawing direction.

Thus, as shown in FIG. 6, a cavity portion 12*d* is made in the first handle 12*c* and, when the first handle 12*c* is rotated in the plate drawing direction and fixed at a predetermined position in a state where the stopper 19 is engaged with this cavity portion 12*d*, a predetermined torsion force (torque) develops in the torsion spring 16, which allows a predetermined biasing force to be applied to the tension bar 10 in the aforesaid plate drawing direction. Moreover, as shown in FIG. 1, a wrench mounting hole 20 is made in the first handle 12*c* and, for rotating the first handle 12*c* to twist the torsion spring 16, it is possible to turn a wrench in a state where the wrench is mounted in the wrench mounting hole 20. Incidentally, if the operation of the first handle 12*c* is conducted at a stage after the assembling, basically, there is no need to conduct the further operation, and the torsion spring 16 can exhibit a predetermined biasing force.

On the other hand, a second supporting shaft 13 is located on a drive side (the other end portion) of the tension bar 10. An operation side end portion 13*a* of the second supporting shaft 13 is inserted and fitted into an engaging hole 14*b* made in the drive side end portion of the tension bar 10. The engaging hole 14*b* made in the drive side end portion of the tension bar 10 is formed into an elliptic (oval) configuration, for example, as shown in FIG. 11(*a*) and the operation side end portion 13*a* of the second supporting shaft 13 is also formed into a generally elliptic configuration, and a minute gap is made between an inner wall of the engaging hole 14*b* and the operation side end portion 13*a* of the second supporting shaft 13. Moreover, a torsion spring (second torsion spring) 21 is provided in a state wound around the outer circumference of the second supporting shaft 13 as shown in FIG. 1. Still moreover, an operation side end portion 21*a* of the torsion spring 21 is inserted and fitted into a spring hole 15*b*, made in a drive side end portion of the tension bar 10, to be stopped in a state engaged therewith, and a drive side end portion 21*b* of the torsion spring 21 twisted by a predetermined quantity in the plate drawing direction is inserted and fitted into a spring engaging hole 22, made in a drive side end portion 13*b* of the second supporting shaft 13, to be stopped in a state engaged therewith. In this connection, since the relative rotation of the second supporting shaft 13 with respect to the tension bar 10 is limited to within a predetermined range, at the assembling of the second supporting shaft 13 and the tension bar 10, the torsion spring 21 can be twisted in advance so as to exhibit a biasing force.

In addition, a second handle (second operating portion) 13*c* is produced on the drive side end portion 13*b* of the second supporting shaft 13. The second handle 13*c* protrudes from the hole section 7 of the sleeve 4 toward the drive side exterior, and the rotational phase position of the tension bar 10 is adjustable by rotating this second handle 13*c*. Still additionally, a wrench mounting hole 24 is also made in the second handle 13*c* and, when the tension bar 10 is rotated at the attachment/detachment of the plate 5, it is rotated in a state where a wrench is mounted in this wrench mounting hole 24.

Yet additionally, as shown in FIGS. 1 and 7, a stopper 25 is inserted and fitted into the drive side end portion 13*b* of the second supporting shaft 13 in a direction perpendicular to the second supporting shaft 13. The stopper 25 is fixedly secured to the second supporting shaft 13 and, when the second handle 13*c* is rotated in the plate fastening direction or in the plate withdrawing direction as shown in FIG. 7, it is rotated integrally with the second supporting shaft 13.

Furthermore, as shown in FIGS. 7, 8 and 9, plunger pins 26 and 27 are planted on the operation side with respect to the stopper 25, and the plunger pins 26 and 27 are made to come into contact with an operation side surface of the stopper 25 by means of belleville springs 26*a* and 27*a*, respectively.

Figures 10A, 10B, 10C:
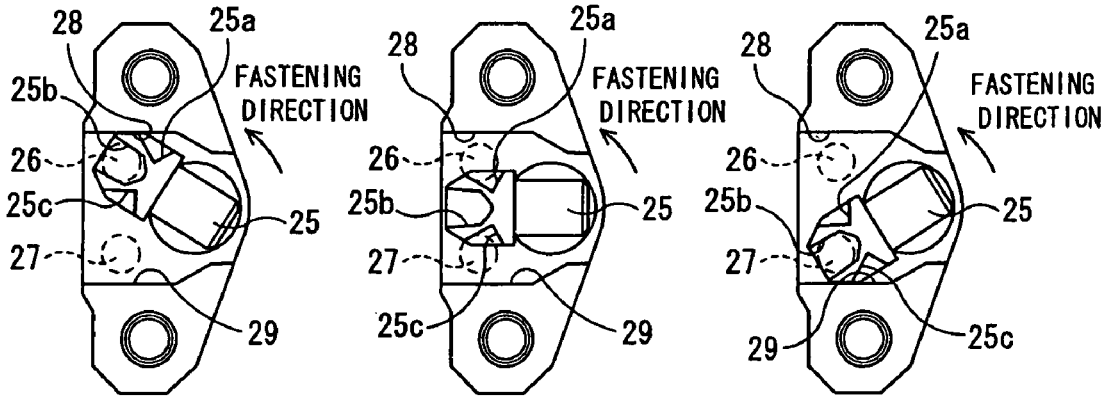
[FIG. 10] FIGS. 10(*a*), 10(*b*) and 10(*c*) are illustrations for explaining operations of a rotating mechanism.
Figure 11A:
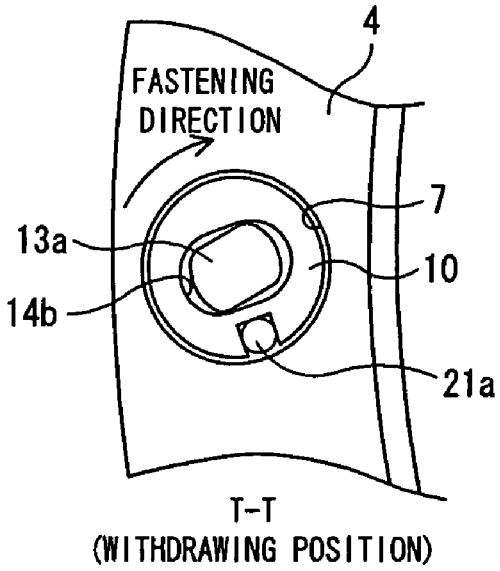
[FIG. 11] FIGS. 11(*a*), 11(*b*), 11(*c*) and 11(*d*) are cross-sectional views taken along T-T of FIG. 1.
Figure 11B:
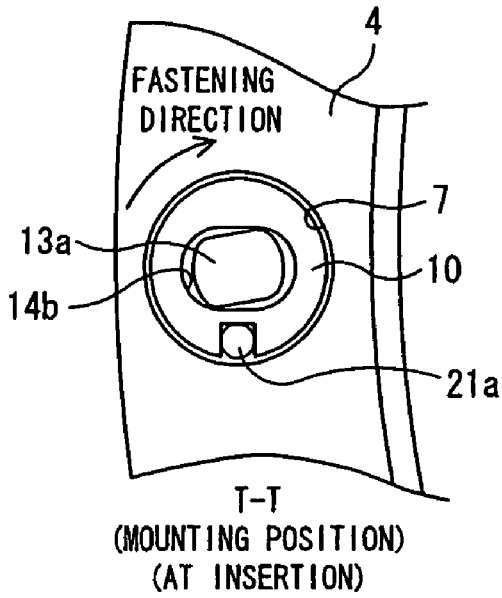
Figure 11C:
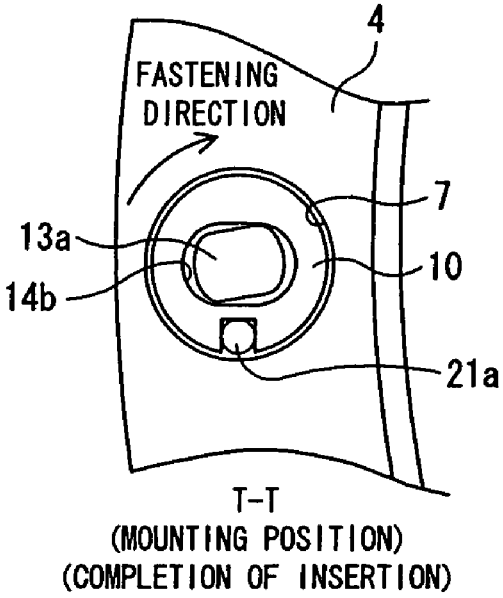
Figure 11D:
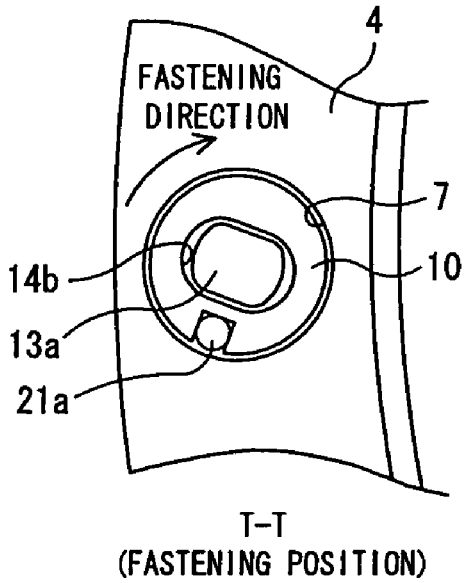
Figure 12A:
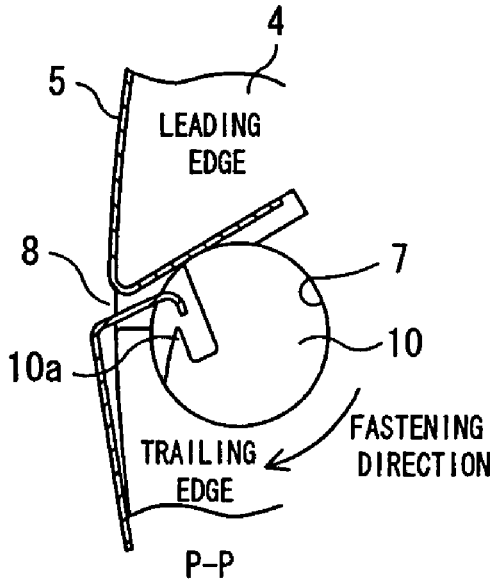
[FIG. 12] FIGS. 12(*a*), 12(*b*), 12(*c*) and 12(*d*) are cross-sectional views taken along P-P of FIG. 1.
Figure 12B:
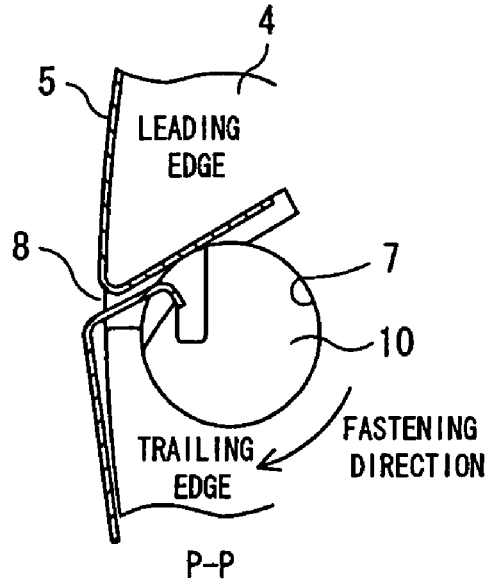
Figure 12C:
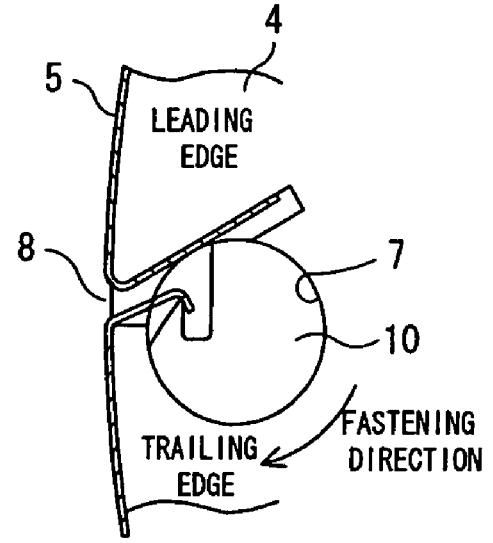
Figure 12D:
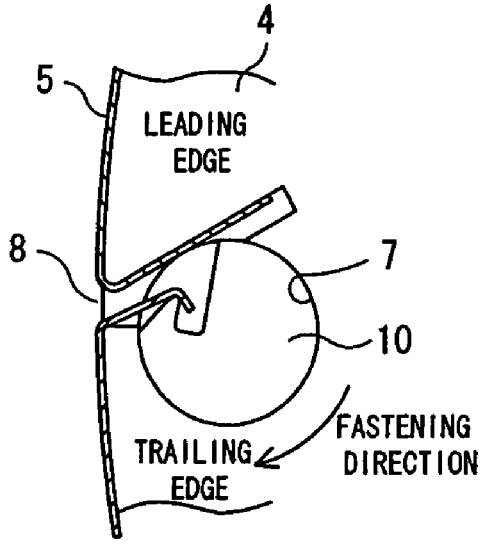

Still furthermore, as shown in FIGS. 10(*a*) to 10(*c*), three cavity portions 25*a*, 25*b* and 25*c* are made in the operation side surface of the stopper 25, and these cavity portions 25*a*, 25*b* and 25*c* are properly engaged with the plunger pins 26 and 27, thereby enabling the second handle 13*c* to be fixed at three positions of a withdrawing position of the plate 5 (position where the trailing edge end portion of the plate 5 is released from the hook 10*a* of the tension bar 10 and detached from the groove section 8 of the sleeve 4) shown in FIG. 10(*a*), a mounting position of the plate 5 (position where the trailing edge end portion of the plate 5 is stopped in a state engaged with the hook 10*a* of the tension bar 10) shown in FIG. 10(*b*) and a fastening position of the plate 5 (position where the trailing edge end portion of the plate 5 is drawn into the groove section 8 of the sleeve 4 by the hook 10*a* of the tension bar 10 and the plate 5 is fastened onto a circumferential surface of the sleeve 4.

In this case, the withdrawing position of the plate 5 corresponds to the case in which the cavity portion 25*b* of the stopper 25 is engaged with the plunger pin 26 as shown in FIG. 10(*a*), and the mounting position of the plate 5 corresponds to a case in which, as shown in FIG. 10(*b*), the cavity portion 25*a* of the stopper 25 is engaged with the plunger pin 26 and the cavity portion 25*c* of the stopper 25 is engaged with the plunger pin 27, and the fastening position of the plate 5 corresponds to a case in which the cavity portion 25*b* of the stopper 25 is engaged with the plunger pin 27 as shown in FIG. 10(*c*). A restriction wall 28 restricts the stopper 25 so as to prevent the stopper 25 from further rotating in a direction opposite to the fastening direction at the withdrawing position of the plate 5, and a restriction wall 29 restricts the stopper 25 so as to prevent the stopper 25 from further rotating in the fastening direction at the fastening position of the plate 5.

Yet furthermore, as shown in FIGS. 11(*a*) to 11(*d*), since the tension bar 10 is biased in the fastening direction of the plate 5 by means of the torsion spring 16 and the torsion spring 21, when the operation side end portion 13*a* of the second supporting shaft 13 is shifted in the order of the withdrawing position of the plate 5, the mounting position thereof and the fastening position thereof, in a state where the engaging hole 14*b* of the tension bar 10 is brought into contact with the operation side end portion 13*a* of the second supporting shaft 13, the tension bar 10 follows the rotation of the operation side end portion 13*a* of the second supporting shaft 13 and is rotated in the plate 5 fastening direction.

As mentioned above, a space exists between the operation side end portion 13*a* of the second supporting shaft 13 and the engaging hole 14*b* of the tension bar 10 and, while the operation side end portion 13*a* of the second supporting shaft 13 is rotated from the plate 5 mounting position shown in FIG. 11(*c*) up to the plate 5 fastening position shown in FIG. 11(*d*), even if the tension bar 10 cannot be further rotated because the tension bar 10 falls into a trailing edge end portion fastening state, the operation side end portion 13*a* of the second supporting shaft 13 is rotated up to the plate 5 fastening position shown in FIG. 11(*d*). Thus, as shown in FIG. 12(*d*), it is possible that the trailing edge end portion of the plate 5 is reliably drawn into the groove section 8 of the sleeve 4 so as to fasten the plate 5 onto the circumferential surface of the sleeve 4.

In addition, when the operation side end portion 13*a* of the second supporting shaft 13 is at the plate 5 fastening position shown in FIG. 11(*d*), a space (clearance) whereby the tension bar 10 is further rotatable by a predetermined quantity in the plate 5 fastening direction is defined between the operation side end portion 13*a* of the second supporting shaft 13 and the engaging hole 14*b* of the tension bar 10. Thus, even if the plate 5 lengthens after the plate fastening and the trailing edge end portion of the plate 5 shifts, the tension bar 10 is rotated in the plate 5 fastening direction according to this shifting, so the trailing edge end portion of the plate 5 can be drawn into the groove section 8 of the sleeve 4, which can prevent the plate 5 from becoming loose, thereby reliably fastening the plate 5 onto the circumferential surface of the sleeve 4.

The holding apparatus 1 according to an embodiment of the present invention is configured as described above, and the attachment and detachment of the plate 5 on and from the circumferential surface of the sleeve 4 are made as follows.

First of all, as shown in FIG. 12(*b*), the leading edge end portion of the plate 5 is inserted into the groove section 8 of the sleeve 4 and the plate 5 is wound around on the circumferential surface of the sleeve 4 and the trailing edge end portion of the plate 5 is inserted into the groove section 8 of the sleeve 4. At this time, the second handle 13*c* is operated so that the stopper 25 comes to the mounting position shown in FIG. 10(*b*), and the hook 10*a* of the tension bar 10 is placed at a position shown in FIG. 12(*b*). In this state, the trailing edge end portion of the plate 5 is inserted into the groove section 8 of the sleeve 4 so as to draw an involute curve as shown in FIG. 13, and a curved tip portion of the trailing edge end portion of the plate 5 is hooked by the hook 10*a* of the tension bar 10 while climbing over the hook 10*a* thereof. Thus, the trailing edge end portion of the plate 5 can be hooked by the hook 10*a* of the tension bar 10 and fixed as shown in FIG. 12(*c*) only by pushing the trailing edge end portion of the plate 5 into the groove section 8 of the sleeve 4, so the trailing edge end portion of the plate 5 does not get out of place during the plate 5 mounting operation, thereby facilitating the plate 5 mounting operation. The leading edge end portion of the plate 5 is held and fixed between an inner wall of the groove section 8 of the sleeve 4 and an circumferential surface of the tension bar 10.

Following this, the second handle 13*c* (see FIG. 7) is rotated in the fastening direction so that the stopper 25 reaches the fastening position shown in FIG. 10(*c*), and the hook 10*a* of the tension bar 10 is rotated to the position shown in FIG. 12(*d*) so that the trailing edge end portion of the plate 5 is drawn into the groove section 8 of the sleeve 4. Thus, it is possible to easily and reliably fasten the plate 5 onto the circumferential surface of the sleeve 4.

Moreover, at the detachment of the plate 5, the second handle 13*c* (see FIG. 7) is rotated in a direction (plate withdrawing direction) opposite to the fastening direction so that the stopper 25 reaches the withdrawing position shown in FIG. 10(*a*), and the hook 10*a* of the tension bar 10 is rotated to the position shown in FIG. 12(*a*) to detach the trailing edge end portion of the plate 5 from the hook 10*a* of the tension bar 10. At this time, the plate 5 springs out from the groove section 8 of the sleeve 4 by means of elastic force. This allows the plate 5 to be easily pulled out from the groove 8 of the sleeve 4.

As described above, this holding apparatus 1 has a configuration in which the rotating mechanism 11 together with the tension bar 10 is incorporated into the hole section 7 of the sleeve 4, which allows the apparatus to be more compact and enables the apparatus to be provided even in the sleeve 4 having, for example, a thickness of approximately 20 mm like this embodiment.

In addition, since a rotating force is applied to the tension bar 10 by means of the torsion springs 16 and 21 placed on the both the end portions of the tension bar 10 in the axial directions thereof, it is possible to apply uniform biasing forces to both the end portions of the tension bar 10, which can reduce the torsion of the tension bar 10.

Still additionally, as shown in FIG. 12(*c*), when the trailing edge end portion of the plate 5 is inserted into the groove section 8 of the sleeve 4, by pushing the trailing edge end portion of the plate 5 thereinto, the trailing edge end portion of the plate 5 climbs over the hook 10*a* of the tension bar 10 and is hooked by the hook 10*a* of the tension bar 10, so the trailing edge end portion of the plate 5 does not depart from the hook 10*a* of the tension bar 10 even if it is released from hands thereafter.

Yet additionally, the positioning mechanism composed of the stopper 25 and the plunger pins 26 and 27 shown in FIGS. 10(*a*) to 10(*c*) can easily set the tension bar 10 at three positions of the withdrawing position, the mounting position and the fastening position. Therefore, one person can easily conduct the operations for the attachment and detachment of a plate.

Moreover, difficulty was so far experienced in mounting a leaf spring on a tension bar, whereas this holding apparatus 1 does not require a conventional leaf spring, thereby facilitating the apparatus assembling. Still moreover, according to conventional techniques, there is a possibility that difficulty is encountered in drawing a plate in a case in which a tip portion of a leaf spring and a trailing edge end portion of the plate do not accurately engage with each other, whereas this holding apparatus 1 can eliminate such a possibility.

Still moreover, as a technique of mounting a plate on a circumferential surface of a sleeve, for example, there has been known a technique in which, like a general flexo printing, a plate is directly adhered through an adhesive material to a circumferential surface of a sleeve. However, such an adhesion makes it difficult to reuse the plate because the plate is damaged when peeled off. On the other hand, this holding apparatus 1 employs a manner that the plate 5 is held in a state hooked by the hook 10*a* of the tension bar 10 as shown in FIG. 12(*d*), thereby allowing the reuse without damaging the plate 5.

Although the embodiment of the present invention has been described above, the present invention is not limited to the above-described embodiment, and it covers all changes and modifications of the embodiment of the invention herein which do not constitute departures from the spirit and scope of the invention.

The invention claimed is:

1. A holding apparatus for holding a flexible plate, comprising:

a holder for holding the flexible plate around a circumferential surface thereof;

a hole section formed in the holder along an axial direction of the holder;

a groove section formed on the circumferential surface of the holder along the axial direction to connect with said hole section for accepting insertion of one edge as a leading edge end portion and another edge as a trailing edge end portion of the plate;

a tension bar inserted and fitted into said hole section for engaging the trailing edge end portion of the plate; and a rotating mechanism provided in said hole section for rotating said tension bar, wherein said rotating mechanism comprises:

a first supporting shaft rotatably and slidably inserted and fitted into an engaging hole formed at one end portion of the tension bar;

a second supporting shaft inserted and fitted into another engaging hole formed at the other end portion of the tension bar for limiting a relative rotation of the second supporting shaft with respect to the tension bar within a predetermined range;

a first torsion spring wound around the first supporting shaft for engaging between the one end portion of the tension bar and one end portion of the first supporting shaft;

a second torsion spring wound around the second supporting shaft for engaging between the other end portion of the tension bar and one end portion of the second supporting shaft;

a first operating portion formed at said one end portion of the first supporting shaft;

a second operating portion formed at said one end portion of the second supporting shaft;

a first stopper fixing the first supporting shaft at a position where a predetermined biasing force develops at the first torsion spring; and a second stopper fixing the second supporting shaft at a mounting position where the trailing edge end portion is set in the groove section.

2. The holding apparatus according to claim 1, wherein said tension bar has a hook for engaging the trailing edge end portion of the plate.

3. The holding apparatus according to claim 1, wherein the holder is a cylindrical sleeve.

4. The holding apparatus according to claim 1, wherein the second supporting shaft is assembled for limiting the relative rotation of the second supporting shaft with respect to the tension bar within a predetermined range with the biasing force being exhibited by applying a twist to the second torsion spring.

5. The holding apparatus according to claim 1, wherein the another engaging hole formed in the other end portion of the tension bar has an elliptic shape, the second supporting shaft has the other end with an elliptic shape, and a gap is formed between an inner wall of the engaging hole and the other end portion of the second supporting shaft.

6. A holding apparatus for holding a flexible plate, comprising:

a holder for holding the flexible plate around a circumferential surface thereof;

a hole section formed in the holder along an axial direction of the holder;

a groove section formed on the circumferential surface of the holder along the axial direction to connect with said hole section for accepting insertion of one edge as a leading edge end portion and another edge as a trailing edge end portion of the plate;

a tension bar inserted and fitted into said hole section for engaging the trailing edge end portion of the plate; and a rotating mechanism provided in said hole section for rotating said tension bar, wherein said rotating mechanism comprises:

a first supporting shaft rotatably and slidably inserted and fitted into an engaging hole formed at one end portion of the tension bar;

a second supporting shaft inserted and fitted into another engaging hole formed in the other end portion of the tension bar for limiting a relative rotation of the second supporting shaft with respect to the tension bar within a predetermined range;

a first torsion spring wound around the first supporting shaft for engaging between the one end portion of the tension bar and one end portion of the first supporting shaft;

a second torsion spring wound around the second supporting shaft for engaging between the other end portion of the tension bar and one end portion of the second supporting shaft;

a first operating portion formed at said one end portion of the first supporting shaft;

a second operating portion formed at said one end portion of the second supporting shaft;

a first stopper fixing the first supporting shaft at a position where a predetermined biasing force develops at the first torsion spring; and a second stopper for fixing the second supporting shaft to one of a mounting position at which the trailing edge end portion is set in said groove section, a fastening position at which the trailing edge end portion is drawn into said groove section and the plate is fastened onto a circumferential surface of the holder, and a withdrawing position at which the trailing edge end portion is released from the interior of said groove section.

7. A holding apparatus for holding a flexible plate, comprising:

a holder for holding the flexible plate around a circumferential surface thereof;

a hole section formed in the holder along an axial direction of the holder;

a groove section formed on the circumferential surface of the holder along the axial direction to connect with said hole section for accepting insertion of one edge as a leading edge end portion and another edge as a trailing edge end portion of the plate;

a tension bar inserted and fitted into said hole section for engaging the trailing edge end portion of the plate; and a rotating mechanism provided in said hole section for rotating said tension bar, wherein said rotating mechanism comprises:

a first supporting shaft rotatably and slidably inserted and fitted into an engaging hole formed at one end portion of the tension bar;

a second supporting shaft inserted and fitted into another engaging hole formed in the other end portion of the tension bar for limiting a relative rotation of the second supporting shaft with respect to the tension bar within a predetermined range;

a first torsion spring wound around the first supporting shaft for engaging between the one end portion of the tension bar and one end portion of the first supporting shaft;

a second torsion spring wound around the second supporting shaft for engaging between the other end portion of the tension bar and one end portion of the second supporting shaft;

first operating means formed at said one end of the first supporting shaft and operated to provide an urging force to the first torsion spring;

second operating means formed at said one end of the second supporting shaft for adjusting rotational phase position of the tension bar;

first fixing means for fixing the first supporting shaft at a position where a predetermined biasing force develops in the first torsion spring; and second fixing means for fixing the second supporting shaft to one of a mounting position at which the trailing edge end portion is set in said groove section, a fastening position at which the trailing edge end portion is drawn into said groove section and the plate is fastened onto a circumferential surface of the holder, and a withdrawing position at which the trailing edge end portion is released from the interior of said groove section.

* * * * *